US009074432B1

(12) United States Patent
Crosby et al.

(10) Patent No.: US 9,074,432 B1
(45) Date of Patent: Jul. 7, 2015

(54) COIL TUBING INJECTOR USING LINEAR BEARINGS

(71) Applicant: Total E&S, Inc., Granbury, TX (US)

(72) Inventors: Mark Allan Crosby, Saginaw, TX (US); Brian K. Fuerstenberg, Granbury, TX (US)

(73) Assignee: Total E&S, Inc., Granbury, TX (US)

( * ) Notice: Subject to any disclaimer, the term of this patent is extended or adjusted under 35 U.S.C. 154(b) by 0 days.

(21) Appl. No.: 14/639,467

(22) Filed: Mar. 5, 2015

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS

| | | | | |
|---|---|---|---|---|
| 4,085,796 | A | 4/1978 | Council | |
| 4,251,176 | A | 2/1981 | Sizer et al. | |
| 4,381,904 | A | 5/1983 | Kyte et al. | |
| 4,515,220 | A | 5/1985 | Sizer et al. | |
| 4,781,250 | A | 11/1988 | McCormick et al. | |
| 4,919,204 | A | 4/1990 | Baker et al. | |
| 4,945,938 | A | 8/1990 | Ponsford et al. | |
| 5,191,173 | A | 3/1993 | Sizer et al. | |
| 5,244,046 | A | 9/1993 | Council et al. | |
| 5,553,668 | A | 9/1996 | Council et al. | |
| 5,775,417 | A | 7/1998 | Council | |
| 6,209,634 | B1 | 4/2001 | Avakov et al. | |
| 2003/0034162 | A1* | 2/2003 | Kulhanek | 166/384 |
| 2003/0209346 | A1* | 11/2003 | Austbo et al. | 166/77.2 |
| 2006/0081368 | A1* | 4/2006 | Rosine et al. | 166/77.3 |
| 2011/0168401 | A1* | 7/2011 | Hebert | 166/351 |

* cited by examiner

*Primary Examiner* — David Andrews
(74) *Attorney, Agent, or Firm* — McGlinchey Stafford, PLLC; R. Andrew Patty, II

(57) ABSTRACT

A coiled tube injection drive assembly having a pair of opposed, upwardly extending movable carriages positioned in opposed fashion so that portions of tubing may be vertically disposed and engaged between the movable carriages, each of the movable carriages comprising a respective gripper chain and associated bearing chain assembly, where the bearing chain is mounted on sprockets that are coaxially disposed between spaced apart gripper chain sprocket wheels so that the bearing sprockets are mounted about the same shafts as the gripper chain sprockets, without being directly mounted to rotate with those shafts. Other assembly features and related methods are also described.

14 Claims, 10 Drawing Sheets

COIL TUBING INJECTOR USING LINEAR BEARINGS

TECHNICAL FIELD

The invention relates generally to coiled tubing injection machines which lower and raise a length of tubing from a coil into and out of a well.

THE INVENTION

Coiled tubing injectors are used, for example, to insert coiled tubing into finished wells for periodic servicing, temporarily suspending the tubing in the well, and for extracting coiled tubing from the well. These injectors generally comprise a base, a carriage extending upward from the base, and a gripper chain drive system mounted in the carriage. The coiled tubing is drawn from, or reeled back in upon, a spool. The base is connected to a superstructure which is mounted above a wellhead.

The gripper chain drive system sits at the center of a tubing injector, comprising a pair of opposing, endless chains which are arranged in a vertical common plane. A multitude of gripper blocks are attached along each of the opposing chains that sequentially grasp the coiled tubing that is positioned between the opposing gripper chains. When the gripper chains are in motion, each chain has a gripper block that is coming into contact with the coiled tubing as another gripper block on the same gripper chain is breaking contact with the coiled tubing. This continues in an endless fashion as the gripper chains are driven to force the tubing into or out of the wellbore, depending on the direction in which drive sprockets, to which the chains are engaged, rotate. The drive sprockets typically are powered and rotated by a reversible hydraulic motor in connection with a gear drive.

The gripper chains are driven by respective drive sprockets which are each, in turn, powered by the reversible hydraulic motor. Each gripper chain is also provided with a respective idler sprocket to maintain each gripper chain within the common plane. Both the drive sprockets and idler sprockets are mounted on a common frame wherein the distance between centers of all the drive and idler sprockets are essentially of a constant distance from each other. That is, the drive sprockets are free to rotate but are not free to move either vertically or laterally with respect to each other. The idler sprockets are not free to move laterally with respect to each other, but are vertically adjustable within a limited amount in order to set the amount of play in each gripper chain. Such vertical adjustment typically is enabled by either a mechanical adjusting means when the device is not in operation, or a hydraulic ram that continuously self-adjusts, even while the device is in operation.

Because the gripper chain drive sprockets and idler sprockets are essentially in a fixed relationship with each other, each gripper chain is provided with a predetermined amount of slack which allows the gripper chain to be biased against the coiled tubing to inject the tubing into and out of the wellbore. This biasing of each of the gripper chains is accomplished with respective endless roller chains disposed inside each of the gripper chains. Each roller chain engages roller chain sprockets rotatably mounted on a respective linear bearing beam. A linkage and hydraulic cylinder mechanism allows the linear bearing beams to be moved toward one another so that each roller chain is moved against its corresponding gripper chain such that the tubing facing portion of the gripper chain is moved toward the tubing so that the gripper blocks can engage the tubing and move it through the apparatus. The gripper blocks will engage the tubing along a working length of the linear beam.

The fixed distance between each set of gripper chain drives and idler sprockets requires some significant lateral movement in the gripper chain when engaged by the roller chain on the corresponding linear beam in order to allow the gripper chains to engage the tubing by way of the gripper blocks. The reason for having the requisite amount of lateral play in the gripper chains is to provide a limited amount of clearance between the gripper chains, upon moving the respective roller chains away from the vertical center line of the injector, to allow the passage of tubing and tools having larger outside diameters or dimensions.

An inherent shortcoming in this design is the difficulty of constructing the gripper chain so that it accepts the hydraulic ram pressure as the grips hold a length of tubing. A number of approaches are used to push the gripper chains together, such as, e.g., bearings in the gripper chain so they can be pushed against a linear race as the chain pulls the tubing through the machine. Another shortcoming is the amount of hardware, moving parts, and bulk of the design. The hydraulic drive motor and gears, for example, typically are built such that they substantially extend the tube injectors' physical envelope.

The invention which is the subject of this disclosure addresses one or more of the aforesaid shortcomings of, or otherwise constitute improvements over, existing designs. For example, in one aspect of the invention, there is provided a tube injector apparatus that employs a chain of linear bearings between the gripper chain and the linear race, kept in place by un-driven sprocket gears mounted coaxially with the drive and idler sprockets, such that the gripper chain's useable life is extended substantially without adding materially to the weight of the injector, and adding minimally to the part count.

Thus, in one aspect of the invention there is provided a coiled tube injection drive assembly comprising a pair of opposed, upwardly extending movable carriages positioned in opposed fashion so that portions of tubing may be vertically disposed and engaged between the movable carriages. Each of the movable carriages comprises a respective gripper chain assembly comprising:

an endless gripper chain for engaging a respective side of the portions of tubing, the gripper chain being mounted on (a) a first gripper chain sprocket mounted on a motor-driven first shaft, and (b) an second gripper chain sprocket mounted on a second shaft, the first shaft and the second shaft being spaced apart with their longitudinal axes in substantially parallel alignment, one being disposed above the other such that the endless gripper chain, when rotated about the first gripper chain sprocket and the second gripper chain sprocket, moves within a plane vertically oriented relative to the surface of the earth during use;

an endless bearing chain, a bearing portion of which is deployed between a vertically disposed, substantially linear race and an inner surface of a tube-contacting portion of the endless gripper chain, whereby the bearing portion of the bearing chain is biased in a linear vertical path against the inner surface of the tube-contacting portion of the endless gripper chain; and a first linear bearing sprocket coaxially disposed between a pair of spaced apart drive sprocket wheels formed by the first gripper chain sprocket, and a second linear bearing sprocket coaxially disposed between a pair of spaced-apart second gripper chain sprocket wheels formed by the second gripper chain sprocket, wherein the first linear bearing sprocket is not fixedly mounted to the motor-driven first shaft but is disposed concentrically around the motor-driven first shaft;

wherein each gripper chain of one of the pair of opposed carriages is opposed to the gripper chain of the other one of the pair of opposed carriages, and is rotated, through its respective first gripper chain sprocket and respective motor-driven first shaft, in counter-rotation with respect to the gripper chain of the other one of the pair of opposed carriages, so that when the tubing is engaged by and between the opposed gripper chains of the pair of opposed carriages while the opposed carriages are biased toward one another, the tubing may be (i) injected downwardly into a well or extracted upwardly from the well by the motor-driven counter rotation of the gripper chains of the opposed carriages while the gripper chains contact opposing sides of the tubing, and/or (ii) held in place in a fixed position for a period of time.

In another aspect of the invention, an improvement to a method is provided. The method which is the subject of improvement generally comprises injecting coiled tubing into a well bore in which a length of tubing from a coil is fed into a space between at least a pair of opposed, upwardly extending movable carriages positioned in opposed fashion so that the length of tubing is vertically disposed and engaged between the movable carriages. Each of the movable carriages comprises a respective motorized gripper chain assembly comprising an endless gripper chain mounted on a motor-driven first shaft and an endless bearing chain in contact with an inner surface of a tube-contacting portion of the endless gripper chain. The gripper chains of the opposed carriages engage the length of tubing and move the length of tubing into or out of the well when the gripper chains are moved in counter-rotation relative to each other by the motorized rotation of the first shaft of each respective carriage. The general method has been disclosed previously in various publications, such as, e.g., U.S. Pat. Nos. 5,553,668, 5,775,417 and 6,209,634, the disclosures of which are incorporated herein by reference. The improvement to this general method comprises, with respect to each of the gripper chain assemblies, disposing the endless bearing chain upon a first linear bearing sprocket coaxially disposed between a pair of spaced apart drive sprocket wheels formed by a first gripper chain sprocket mounted on the motor-driven first shaft, and a second linear bearing sprocket coaxially disposed between a pair of spaced-apart second gripper chain sprocket wheels formed by a second gripper chain sprocket mounted on a second shaft. In this way, the gripper chains of each assembly rotate while in contact with a respective bearing chain that is supported upon sprockets that are mounted upon the same drive and/or support shafts as the gripper chain it bears. This significantly reduced the complexity, size and weight of the device.

Other features and advantages of certain aspects of the invention will be apparent to those of ordinary skill in the art upon reference to the following detailed description taken in conjunction with the accompanying claims and drawings.

BRIEF DESCRIPTION OF THE DRAWINGS

Like numeric or letter references found across the several figures are used to refer to like parts or components illustrated therein.

FURTHER DETAILED DESCRIPTION OF THE INVENTION

Figure 1:
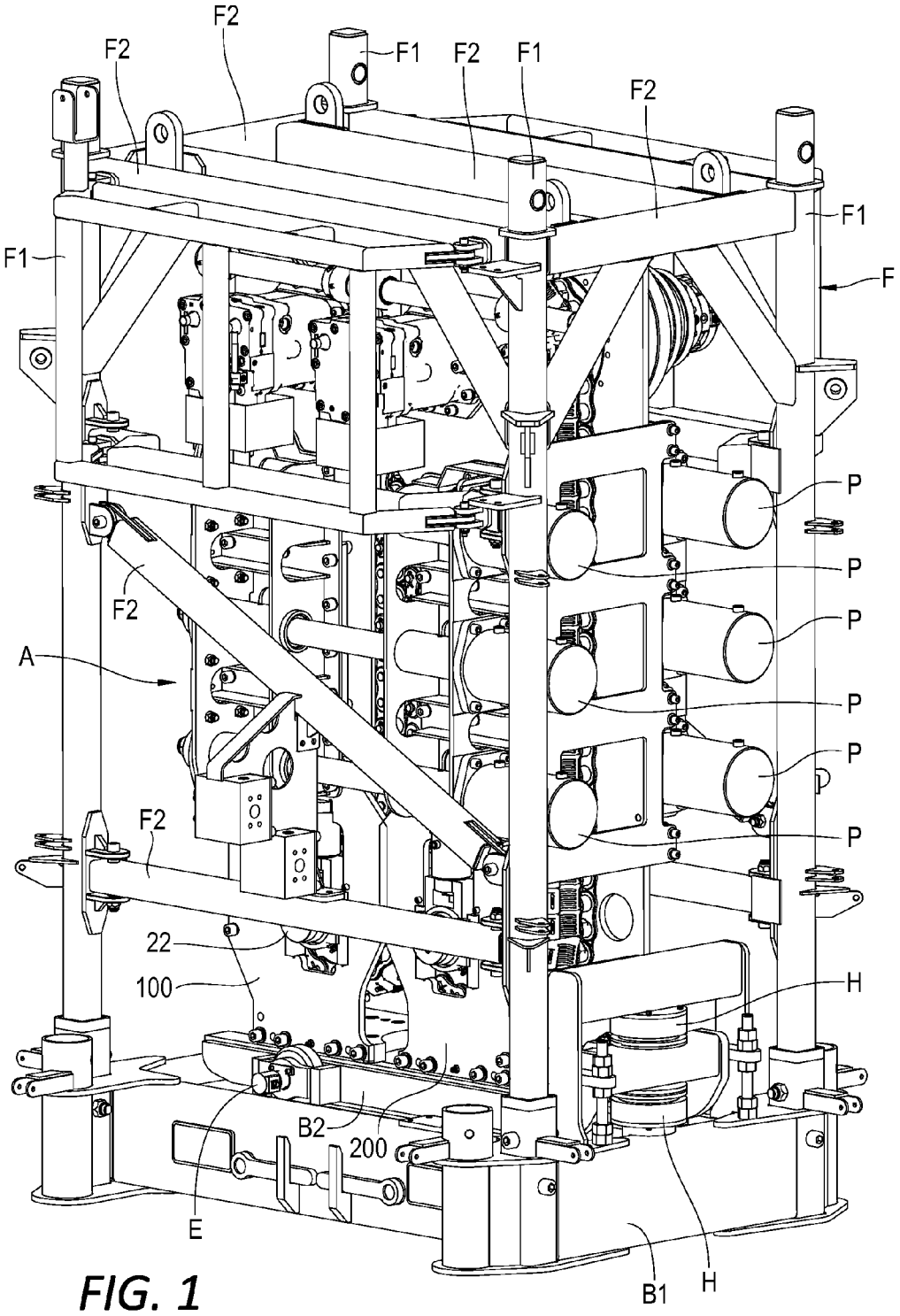
FIG. 1 is one elevated view in perspective of apparatus in accordance with one aspect of the invention, mounted within a supporting framework assembly.
Figure 2:
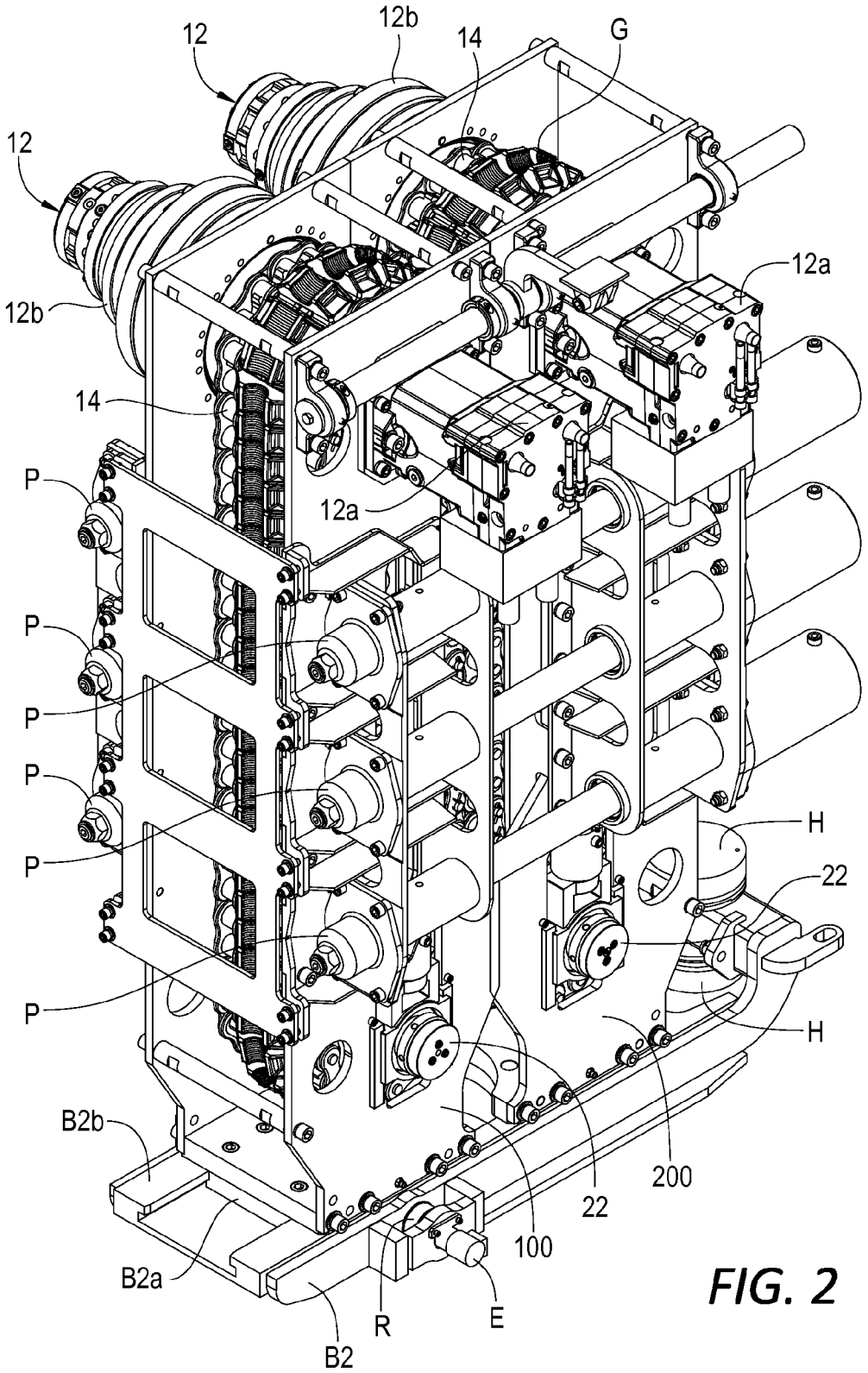
FIG. 2 is another elevated view in perspective of the apparatus of FIG. 1, shown without its supporting framework assembly.
Figure 3:
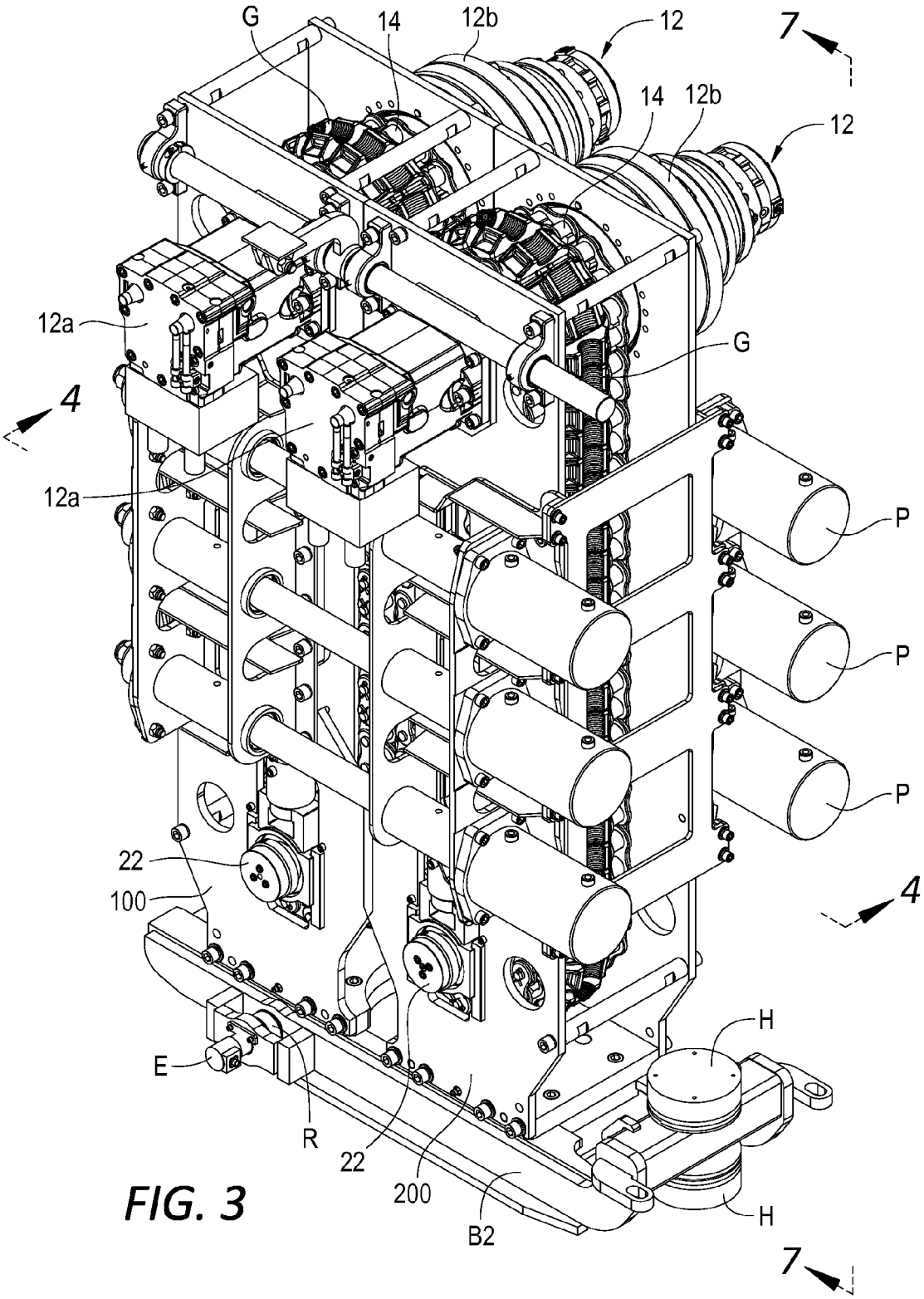
FIG. 3 is another elevated view in perspective of the apparatus of FIG. 2 rotated 90° about a vertical axis of the apparatus.
Figure 4:
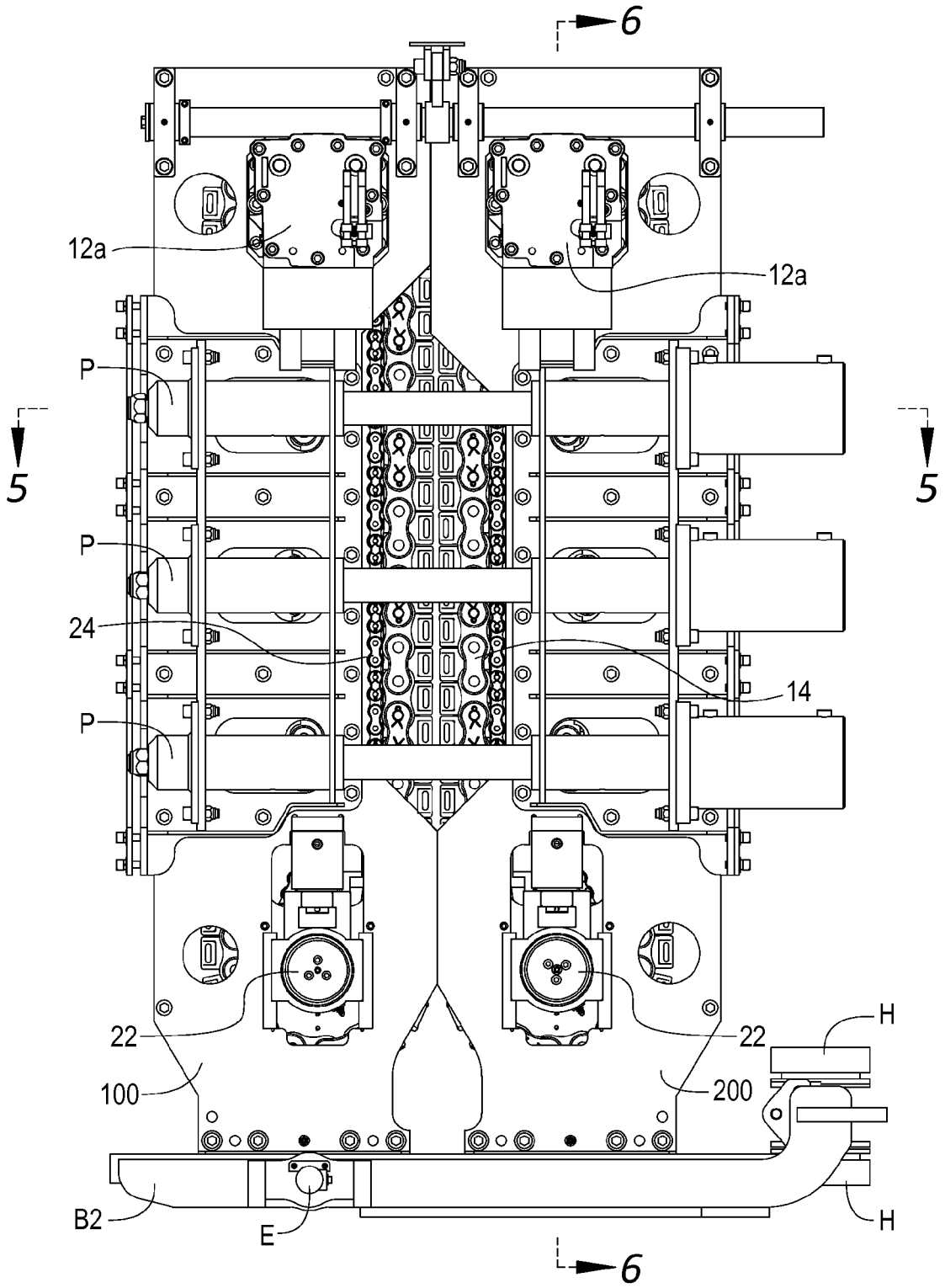
FIG. 4 is a side plan view of the apparatus of FIG. 2, shown from the side indicated by arrowed lines 4-4 in FIG. 3.
Figure 5:
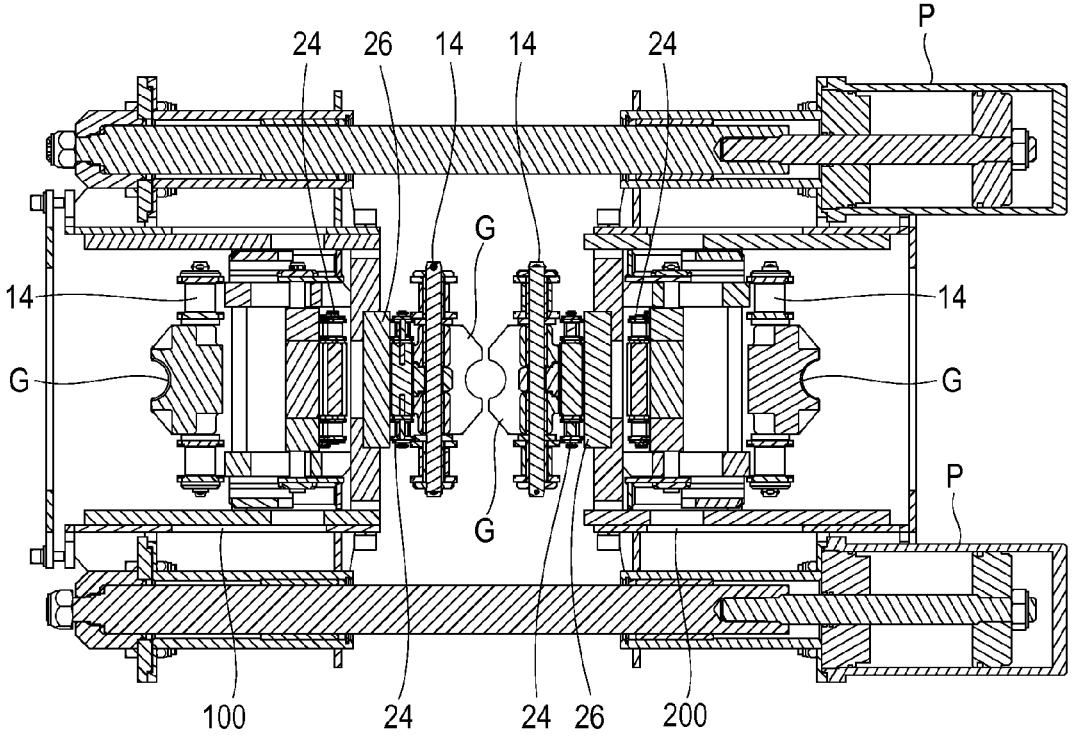
FIG. 5 is a top cross-sectional view of the apparatus of FIG. 2, with the cross-section taken as indicated by arrowed lines 5-5 in FIG. 4.
Figure 6:
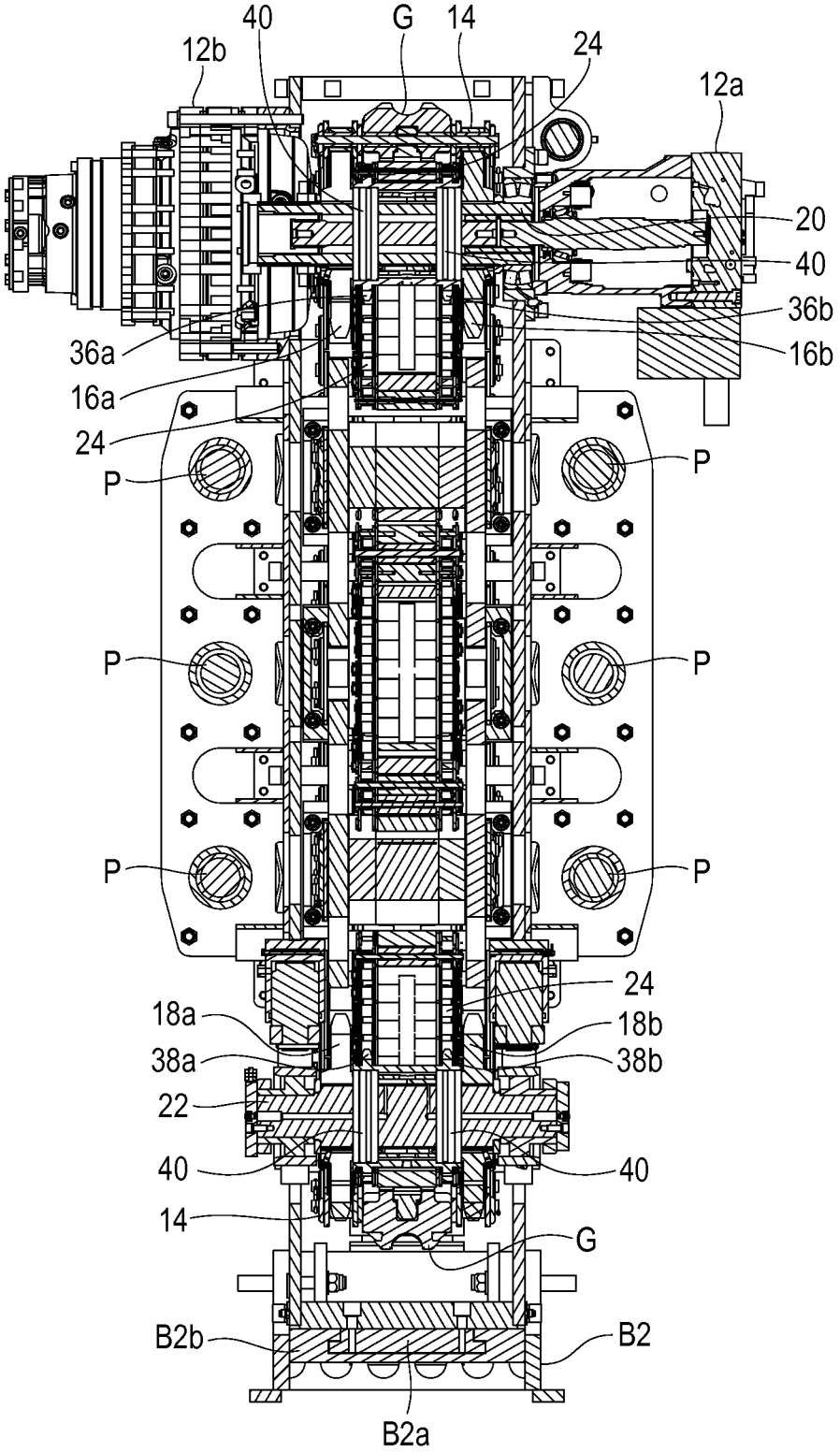
FIG. 6 a side cross-sectional view of the apparatus of FIG. 2, with the cross-section taken as indicated by arrowed lines 6-6 in FIG. 4.
Figure 7:
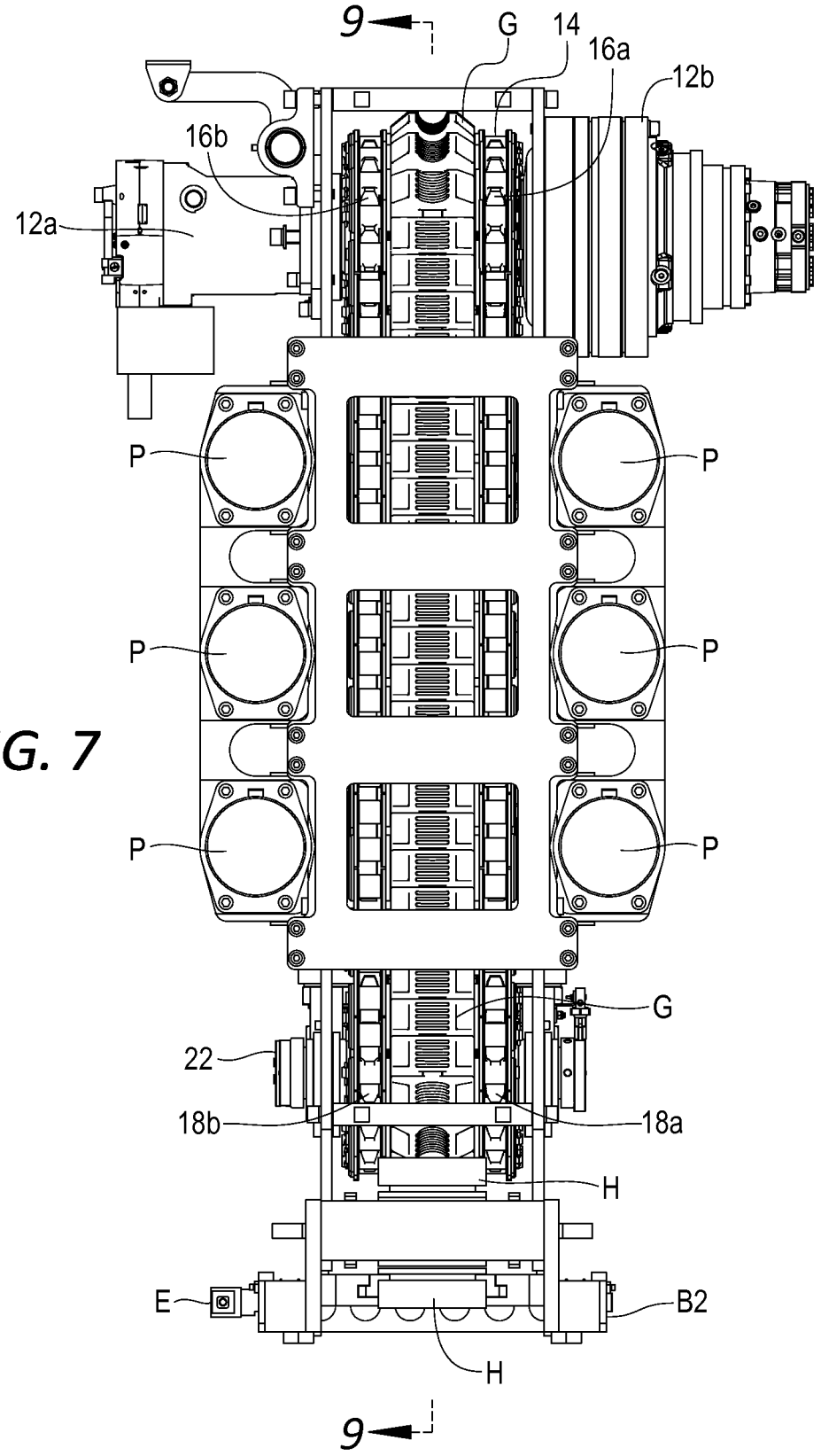
FIG. 7 is a side plan view of the apparatus of FIG. 2, shown from the side indicated by arrowed lines 7-7 in FIG. 3.

As will now be appreciated, the invention deploys linear bearing chains mounted upon respective sprockets that are, in turn, mounted upon the same shafts that host respective gripper chain sprockets upon which the respective gripper chains are mounted. However, by eliminating a direction connection between the gripper chain and its drive assembly, on the one hand, and the linear bearing chain on the other hand, the linear bearing chain avoids any kinking or bunching up over time, and the life of the gripper chain is extended by allowing it to move with the linear bearing chain to minimize friction. The coaxial shaft mounting of the bearing chain sprockets and the gripper chain sprockets adds the advantage of minimization of space in the device and decreasing parts count.

Thus, in one aspect of the invention, the linear bearing chain sprockets, upon which a respective bearing chain is mounted, are not directly affixed to either shaft for rotation therewith. Rather, they may rotate freely thereabout, and are not driven by any motorized action of anything except by possible frictional force from contact with the rotating gripper chain and/or frictional force from sprocket contact with ring bearings mounted to the shafts during rotation of the gripper chain.

Particular aspects or embodiments of the invention will now be illustrated with reference to the illustrative drawings on the accompanying figures. The particular illustrative examples which are described with particularity in this specification are not intended to limit the scope of the invention. Rather, the examples are intended as concrete illustrations of various features and advantages of the invention, and should not be construed as an exhaustive compilation of each and every possible permutation or combination of materials, components, configurations or steps one might contemplate, having the benefit of this disclosure. Similarly, in the interest of clarity, not all features of an actual implementation of a tool or related methods of use are described in this specification. It of course will be appreciated that in the development of such an actual implementation, numerous implementation-specific decisions must be made to achieve the developers' specific goals, such as compliance with system-related and economic-related constraints, which may vary from one implementation to another. Moreover, it will be appreciated that while such a development effort might be complex and time-consuming, it would nevertheless be a routine undertaking for those of ordinary skill in the art having the benefit of this disclosure.

Turning now to the accompanying FIGS. 1-10, illustrated there is one particular aspect of the invention. As noted with particularity on FIG. 1, a coiled tube injection drive assembly 10 is supported within a framework F made up of four pillars F1 and various cross members F2 mounted on a base assembly comprising a bottom base portion B1 and a top base portion B2. Coiled tube injection drive assembly 10 is coupled to top base portion B2 which is pivotally attached to bottom base portion B1 via a pivot rod R. Assembly 10 comprises a pair of opposed, upwardly extending movable carriages 100 and 200 disposed in a common vertical plane, coupled to the top base portion B2 and positioned in opposed fashion so that portions of tubing T (see FIG. 9) may be vertically disposed and engaged between movable carriages 100 and 200 for injection into and/or extraction out of a well bore (not shown) having a wellhead (not shown) upon which bottom base portion B1 is mounted.

When tubing T is dispensed from its coil, it may be fed in between carriages 100 and 200 from above, for injection downwardly into the well above which is disposed drive assembly 10, framework F and base portions B1 and B2. Controlled biasing means illustrated in the form of six hydraulic pistons P bridge between and couple together each of carriages 100 and 200, to controllably retain and urge the carriages together during motorized operation of each carriage's drive assembly. Each carriage is movable in that it is slidably connection to top base portion B2 by a tongue rail B2*a* (see FIG. 2) slidably mated with a grooved rail B2*b* (see FIG. 2) coupled to or integral with top base portion B2.

FIGS. 2-10 illustrate components of the apparatus of FIG. 1, with framework F removed for ease of reference. As seen for example in FIG. 2, each of movable carriages 100 and 200 comprises a respective motorized gripper chain assembly driven by a drive motor 12, each drive motor 12 including a generally square hydraulic motor 12*a* on one side and a generally cylindrical gear box 12*b* on an opposing side. Each motorized gripper chain assembly comprises an endless gripper chain 14 upon which a plurality of steel, contoured gripper blocks G are mounted. Gripper blocks G of chain 14 are configured to engage a respective side of tubing T. Gripper chain 14 is mounted on (a) a first gripper chain sprocket 16 mounted on a first motor-driven shaft 20, and (b) a second gripper chain sprocket 18 mounted on a second idler shaft 22, first driven shaft 20 and second idler shaft 22 being spaced apart with their longitudinal axes in substantially parallel alignment. Driven shaft 20 is disposed above idler shaft 22 such that the endless gripper chain 14 when rotated about the first gripper chain sprocket 16 and the second gripper chain sprocket 18 during operation of the apparatus moves within a plane vertically oriented relative to the ground into which the well bore extends.

Figure 8:
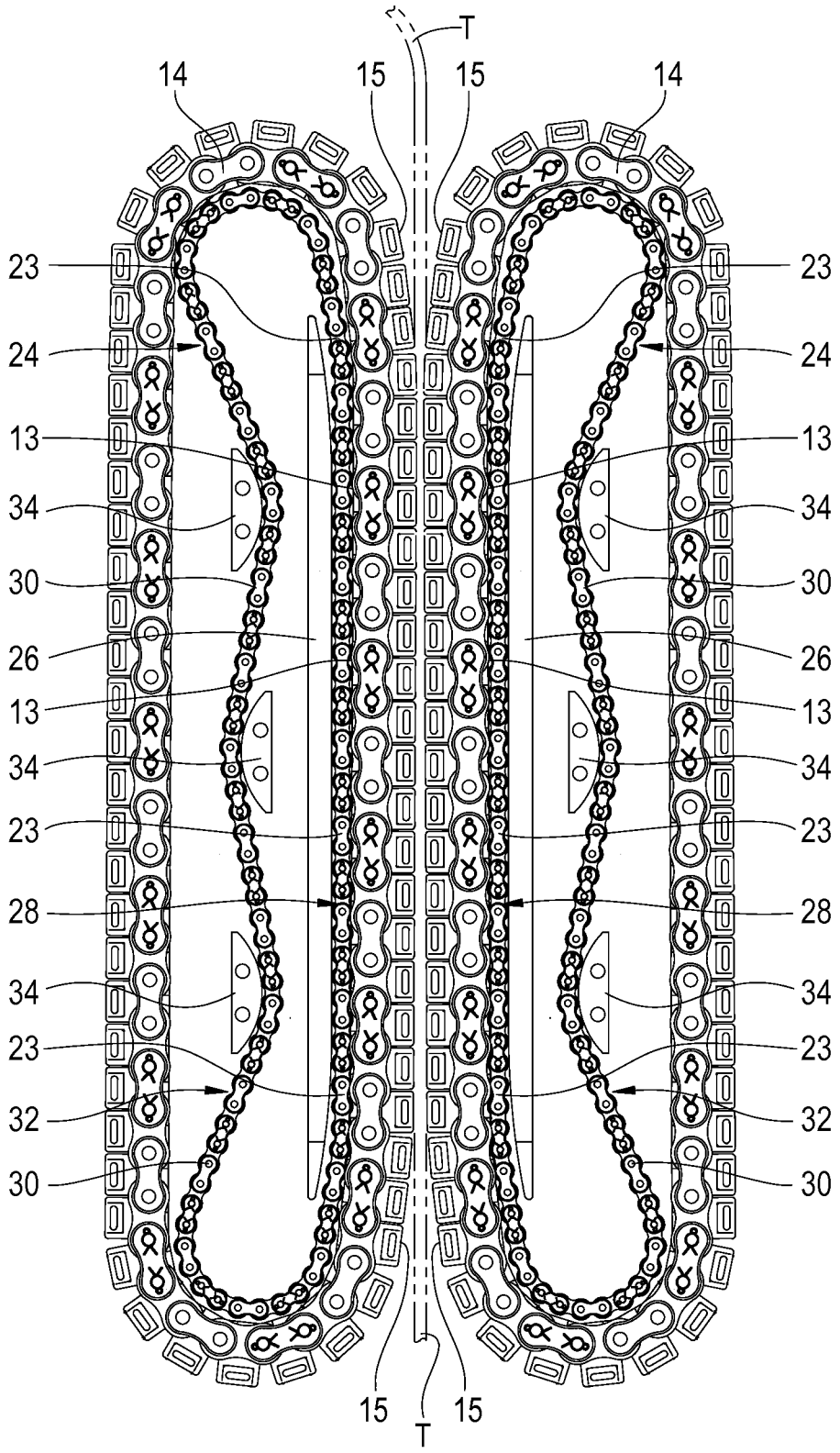
FIG. 8 is a side plan view of the gripper chains and linear bearing chains and associated races of the device of FIGS. 1-7, shown in isolation to illustrate their general position relative to one another.
Figure 9:
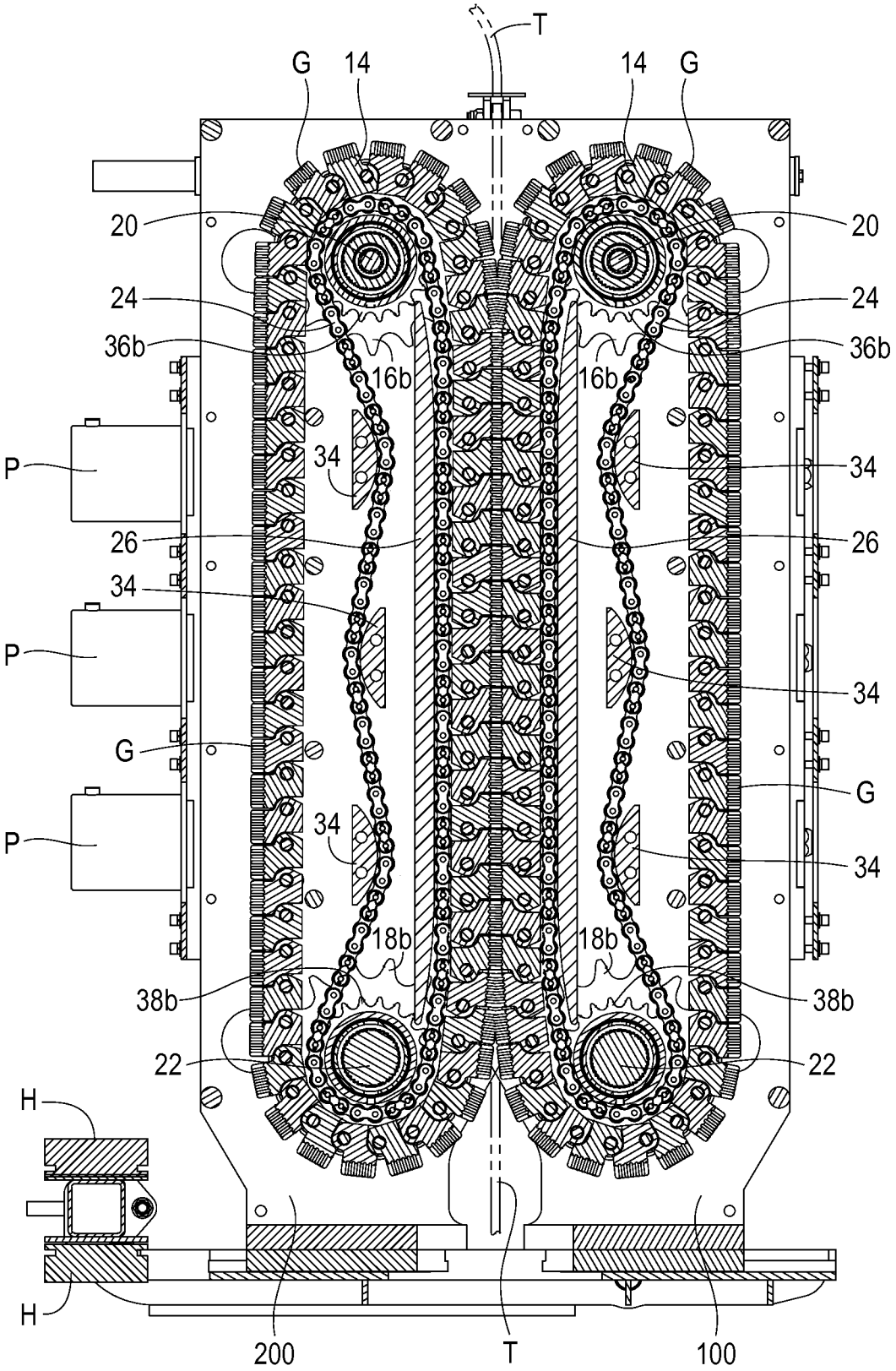
FIG. 9 is a side cross-sectional view of the apparatus of FIG. 2, with the cross-section taken as indicated by arrowed lines 9-9 in FIG. 7.
Figure 10:
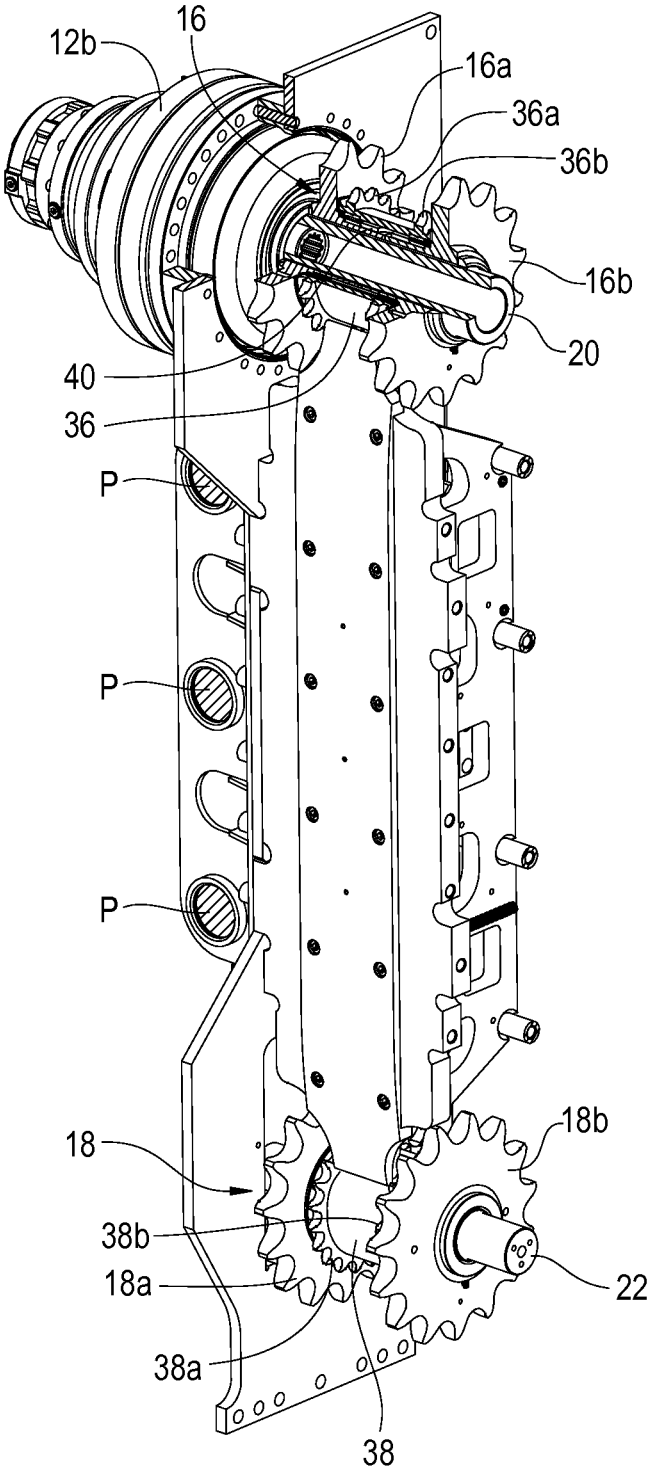
FIG. 10 is an elevated view in perspective, partially cut away, of the motor, drive shaft, idler shaft, drive sprockets, idler sprockets and one carriage plate of the device of FIG. 1.

As can be seen especially with reference to FIGS. 8 and 9, the gripper chain assembly further comprises an endless bearing chain 24, a bearing portion 25 of which is deployed between a vertically disposed, substantially linear race 26 and an inner surface 13 of a tube-contacting portion 15 of endless gripper chain 14, whereby the bearing portion 23 of bearing chain 24 is biased in a linear vertical path 28 against inner surface 13 of tube-contacting portion 15 of endless gripper chain 14. A return portion 30 of endless bearing chain 24 is disposed in a generally vertically disposed serpentine pathway 32 around two or more secondary races 34 and spaced apart from the linear vertical path of the bearing portion 23 of bearing chain 24.

FIGS. 5, 6, 9 and 10 particularly illustrate that the gripper chain assembly further comprises a first linear bearing sprocket 36 coaxially disposed between a pair of spaced apart drive sprocket wheels 16*a* and 16*b* formed by first gripper chain sprocket 16, and a second linear bearing sprocket 38 coaxially disposed between a pair of spaced-apart second gripper chain sprocket wheels 18*a* and 18*b* formed by second gripper chain sprocket 18. First bearing sprocket 36 forms a pair of sprocket wheels 36*a* and 36*b*, and second bearing sprocket 38 forms a pair of sprocket wheels 38*a* and 38*b*. The first linear bearing sprocket 36 is not fixedly mounted to motor-driven first shaft 20, but is disposed concentrically around motor-driven first shaft 20 and may come into contact with one or more bearing rings 40 mounted on first shaft 20 during first shaft 20 motorized rotation. Likewise, second bearing sprocket 38 is not fixedly mounted to idler shaft 22 and may come into contact with one or more bearing rings 40 mounted on second idler shaft 22 during chain movement.

Each gripper chain of one of the pair of opposed carriages 100 and 200 is opposed to the gripper chain of the other one of the pair of opposed carriages 100 and 200, and is rotated, through its respective first gripper chain sprocket 16 and respective motor-driven first shaft 20, in counter-rotation with respect to the gripper chain of the other one of the pair of opposed carriages 100 and 200, so that when the tubing T (FIG. 9) is engaged by and between the opposed gripper chains 14 of the pair of opposed carriages 100 and 200 while carriages 100 and 200 are biased toward one another, tubing T may be (i) injected downwardly into a well or extracted upwardly from the well by the motor-driven counter rotation of the gripper chains 14 of the opposed carriages 100 and 200 while the gripper chains 14 contact opposing sides of tubing T, and/or (ii) held in place in a fixed position for a period of time, as desired and controlled by an operator of the motors of the apparatus.

As previously noted, the injector further comprises one or more controlled biasing means for controllably biasing the opposed carriages 100 and 200 toward one another so as to urge their respective gripper chains 14 into contact with tubing T extending between them. The controlled biasing means may take various forms, including hydraulic pistons, springs, or the like. As illustrated, the controlled biasing means comprises six spaced-apart hydraulic pistons P, each being coupled to, and bridging together, the opposed carriages 100 and 200.

The injector is also equipped with dual load detection, for determining the hanging weight of the tubing extending into the injection apparatus and into the well. One or more electronic scales are provided in the illustrated embodiment in the form of two electronic load pins E, along with a hydraulic scale in the form of a hydraulic load cell H. The electronic scale employed may be one of a variety of commercial available electronic load detectors, but in the illustrated embodiment is electronic load pin model LPE-56-3KECN651-00 commercially available from Martin-Decker Totco, Inc. of Houston, Tex. The electronic scale or load pins may be coupled to any digital or analog gauge that can be attached to, e.g., a 4-20 mA output. In one particular aspect of the invention, the electronic scale is operative coupled to a recording device capable of receiving the load output signals and recording or otherwise processing them over time, to record load detection during injection operations. A wide variety of conventional electronic signal recording devices, computers, etc. with a storage medium may be used for this purpose. The hydraulic scale employed may be one of a variety of commercially available hydraulic load detectors, such as the illustrated, opposed pancake-style hydraulic load cell, commercially available from, e.g., Martin-Decker Totco, Inc. of Houston, Tex., as model E-369. Using both electronic and hydraulic scales in the design of the injector provides redundancy to the system, and enables an operator to verify the accuracy of the load detection under a variety of operating conditions.

While a particular embodiment of the invention has been illustrated in the accompany figures and text describing the same, those of skill in the art can appreciate that the invention may be embodiment in a number of different forms, and those forms may vary from the illustrations set forth herewith without deviating from the spirit and scope of the invention. Thus, for example, there may be variations in certain components, configurations and methods of operation while still embodying the invention. For example, as illustrated, the motor-driven shafts are the upper shafts of the opposed carriages, but it is conceivable that the lower shafts may be the motor-driven shafts, or alternatively, that the upper shaft on one carriage and the lower shaft on the opposed carriage, could be motor-driven. Similarly, the carriages as illustrated move relative to one another by sliding along a grooved rail in response to biasing force applied by the hydraulic pistons, but other mechanical configurations for mobilizing the carriages relative to the base and relative to one another can easily be envisioned by those or ordinary skill in the art having the benefit of this disclosure.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise. Furthermore, aspects of the invention may comprise, consistent essentially of, or consist of the indicated elements or method steps.

This invention is susceptible to considerable variation within the spirit and scope of the appended claims.

The invention claimed is:

1. A coiled tube injection drive assembly comprising a pair of opposed, upwardly extending movable carriages positioned in opposed fashion so that portions of tubing may be vertically disposed and engaged between the movable carriages, each of the movable carriages comprising a respective gripper chain assembly comprising:

an endless gripper chain for engaging a respective side of the portions of tubing, the gripper chain being mounted on (a) a first gripper chain sprocket mounted on a motor-driven first shaft, and (b) an second gripper chain sprocket mounted on a second shaft, the first shaft and the second shaft being spaced apart with their longitudinal axes in substantially parallel alignment, one being disposed above the other such that the endless gripper chain when rotated about the first gripper chain sprocket and the second gripper chain sprocket moves within a plane vertically oriented relative to the surface of the earth during use;

an endless bearing chain, a bearing portion of which is deployed between a vertically disposed, substantially linear race and an inner surface of a tube-contacting portion of the endless gripper chain, whereby the bearing portion of the bearing chain is biased in a linear vertical path against the inner surface of the tube-contacting portion of the endless gripper chain; and a first linear bearing sprocket coaxially disposed between a pair of spaced apart drive sprocket wheels formed by the first gripper chain sprocket, and a second linear bearing sprocket coaxially disposed between a pair of spaced-apart second gripper chain sprocket wheels formed by the second gripper chain sprocket, wherein the first linear bearing sprocket is not fixedly mounted to the motor-driven first shaft but is disposed concentrically around the motor-driven first shaft;

wherein each gripper chain of one of the pair of opposed carriages is opposed to the gripper chain of the other one of the pair of opposed carriages, and is rotated, through its respective first gripper chain sprocket and respective motor-driven first shaft, in counter-rotation with respect to the gripper chain of the other one of the pair of opposed carriages, so that when the tubing is engaged by and between the opposed gripper chains of the pair of opposed carriages while the opposed carriages are biased toward one another, the tubing may be (i) injected downwardly into a well or extracted upwardly from the well by the motor-driven counter rotation of the gripper chains of the opposed carriages while the gripper chains contact opposing sides of the tubing, and/or (ii) held in place in a fixed position for a period of time.

2. A coiled tube injection apparatus as in claim 1, wherein a return portion of the endless bearing chain is disposed in an upwardly disposed serpentine pathway around two or more secondary races and spaced apart from the linear vertical path of the bearing portion of the bearing chain.

3. A coiled tube injection apparatus as in claim 2, wherein each of the carriages is mounted on a base assembly comprising a top base portion and a bottom base portion, the top base portion being hinged to the bottom base portion, and further comprising at least two scales coupled to the injection apparatus for determining the hanging weight of the tubing extending into the injection apparatus and into the well.

4. A coiled tube injection apparatus as in claim 3, wherein the at least two scales comprise an electronic scale and a hydraulic scale.

5. A coiled tube injection apparatus as in claim 4, further comprising one or more controlled biasing means for controllably biasing the opposed carriages toward one another so as to urge their respective gripper chains into contact with tubing extending between the opposed carriages.

6. A coiled tube injection apparatus as in claim 5, wherein the controlled biasing means comprises one or more pneumatic or hydraulic pistons, each of the pistons being coupled to both of the opposed carriages.

7. A coiled tube injection apparatus as in claim 1, further comprising one or more controlled biasing means for controllably biasing the opposed carriages toward one another so as to urge their respective gripper chains into contact with tubing extending between the opposed carriages.

8. A coiled tube injection apparatus as in claim 7, wherein the controlled biasing means comprises one or more pneumatic or hydraulic pistons, each of the pistons being coupled to both of the opposed carriages.

9. In a method of injecting coiled tubing into a well bore in which a length of tubing from a coil is fed into a space between at least a pair of opposed, upwardly extending movable carriages positioned in opposed fashion so that the length of tubing is vertically disposed and engaged between the movable carriages, each of the movable carriages comprising a respective motorized gripper chain assembly comprising an endless gripper chain mounted on a motor-driven first shaft and an endless bearing chain in contact with an inner surface of a tube-contacting portion of the endless gripper chain, the gripper chains of the opposed carriages engaging the length of tubing and moving the length of tubing into or out of the well when the gripper chains are moved in counter-rotation relative to each other by the motorized rotation of the first shaft of each respective carriage, the improvement comprising:

with respect to each of the gripper chain assemblies, disposing the endless bearing chain upon a first linear bearing sprocket coaxially disposed between a pair of spaced apart drive sprocket wheels formed by a first gripper chain sprocket mounted on the motor-driven first shaft, and a second linear bearing sprocket coaxially disposed between a pair of spaced-apart second gripper chain sprocket wheels formed by a second gripper chain sprocket mounted on a second shaft.

10. A method according to claim 9, the method further comprising disposing a return portion of the endless bearing chain in an upwardly extending serpentine pathway around two or more secondary races, the return portion being spaced apart from the linear vertical path of the bearing portion of the bearing chain.

11. A method according to claim 10, further comprising mounting the carriages upon a support, and detecting one or more loads placed upon the carriages during injection and/or extraction of the tubing by concurrently electronically measuring the loads, and hydraulically measuring the loads.

12. A method according to claim 11, further comprising electronically recording the loads measured during injection and/or extraction of the tubing.

13. A method according to claim 9, further comprising mounting the carriages upon a support, and detecting one or more loads placed upon the carriages during injection and/or extraction of the tubing by concurrently electronically measuring the loads, and hydraulically measuring the loads.

14. The method according to claim 13, further comprising electronically recording the loads electronically measured during injection and/or extraction of the tubing.

* * * * *